US008594359B2

(12) United States Patent
Takei

(10) Patent No.: US 8,594,359 B2
(45) Date of Patent: Nov. 26, 2013

(54) EARPHONE

(75) Inventor: Masaki Takei, Yokohama (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 175 days.

(21) Appl. No.: 13/066,213

(22) Filed: Apr. 8, 2011

(65) Prior Publication Data

US 2011/0249856 A1 Oct. 13, 2011

(30) Foreign Application Priority Data

Apr. 13, 2010 (JP) ..... 2010-092121

(51) Int. Cl.
*H04R 25/00* (2006.01)

(52) U.S. Cl.
USPC ..... 381/380; 381/370; 381/371; 381/381; 381/384

(58) Field of Classification Search
USPC ..... 381/370, 380, 384, 371, 381; 181/129–130, 135
See application file for complete search history.

(56) References Cited

U.S. PATENT DOCUMENTS

2009/0233652 A1* 9/2009 Yang ..... 455/569.1
2009/0304220 A1 12/2009 Fujikura et al. ..... 381/380

FOREIGN PATENT DOCUMENTS

JP 2001-333484 11/2001 ..... H04R 1/10
JP 2010-154465 7/2010

* cited by examiner

*Primary Examiner* — Duc Nguyen
*Assistant Examiner* — Matthew Eason
(74) *Attorney, Agent, or Firm* — Renner, Kenner, Greive, Bobak, Taylor & Weber

(57) ABSTRACT

An earphone includes a speaker unit, a housing that covers a rear surface of the speaker unit, and a bushing having a cord holding portion that holds a cord that carries an audio signal to the speaker unit and is running to the outside of the housing. The bushing also has an extended portion that is extended into the housing and spread along an inner surface of the housing. The inner surface of the housing faces the rear surface of the speaker unit.

3 Claims, 5 Drawing Sheets

EARPHONE

CROSS-REFERENCE TO RELATED APPLICATIONS

This application is based on and claims the benefit of priority from the prior Japanese Patent Application No. 2010-092121 filed on Apr. 13, 2010, the entire contents of which are incorporated herein by reference.

BACKGROUND OF THE INVENTION

The present invention relates to an earphone. Specifically, this invention relates to an earphone having a bushing that holds a cord running from a main body of the earphone.

A known earphone is equipped with a main body, a speaker unit installed in the main body, a cord connected to the speaker unit at one end thereof and running from the main body, and a bushing that holds the cord that is running from the main body. Such a known earphone is disclosed, for example, in Japanese Un-Examined Patent Publication No. 2001-333484.

In a known earphone, a main body consists of a plurality of housings.

Specifically, in one type of known earphone, a main body contains a speaker unit and consists of a front housing and a rear housing. The front and rear housings are combined to constitute the main body so that the front one is located at the side of a user's head whereas the rear one is located at the outer side when the earphone is attached to the auricle of the user's ear. The front and rear housings are combined to each other by ultrasonic welding or an adhesive.

Provided at the rear side of the speaker unit in the main body is a back cavity that is a space surrounded by the inner surfaces of the front and rear housings.

The space of the back cavity and the outer space are partitioned only by the front or rear housing. The front and rear housings are usually made by resin molding and hence not so excellent in sound isolation. Thus, the sound emitted at the rear side of the speaker unit travels through the front or rear housing without isolated enough and leaks to the outside of the main body.

Moreover, when the front and rear housings are combined by ultrasonic welding, the faying portions of the housings are joined to each other by point welding with gaps being created between the faying surfaces thereof.

Such gaps are also created between the faying surfaces of the front and rear housings when the housings are combined by an adhesive. This is because it is difficult to apply the adhesive on the faying surfaces so as not to create the gaps in mass production.

Accordingly, it is difficult to avoid the gaps between the front and rear housings when the housings are combined by ultrasonic welding or an adhesive. The sound that leaks from the gaps is comparatively larger than that leaking from the other parts of the main body.

There is a demand for earphones with smaller sound leakage that can be used in a specific environment (such as, in a train) where it is preferable not to leak sounds.

SUMMARY OF THE INVENTION

A purpose of the present invention is to provide an earphone with a dual housing structure that allows smaller sound leakage.

The present invention provides an earphone comprising: a speaker unit; a housing that covers a rear surface of the speaker unit; and a bushing having a cord holding portion that holds a cord that carries an audio signal to the speaker unit and is running to the outside of the housing, and having an extended portion that is extended into the housing and spread along an inner surface of the housing, the inner surface facing the rear surface of the speaker unit.

DETAILED DESCRIPTION OF PREFERRED EMBODIMENT

A preferred embodiment according to the present invention will be described with reference to FIGS. 1 to 5.

Figure 1:
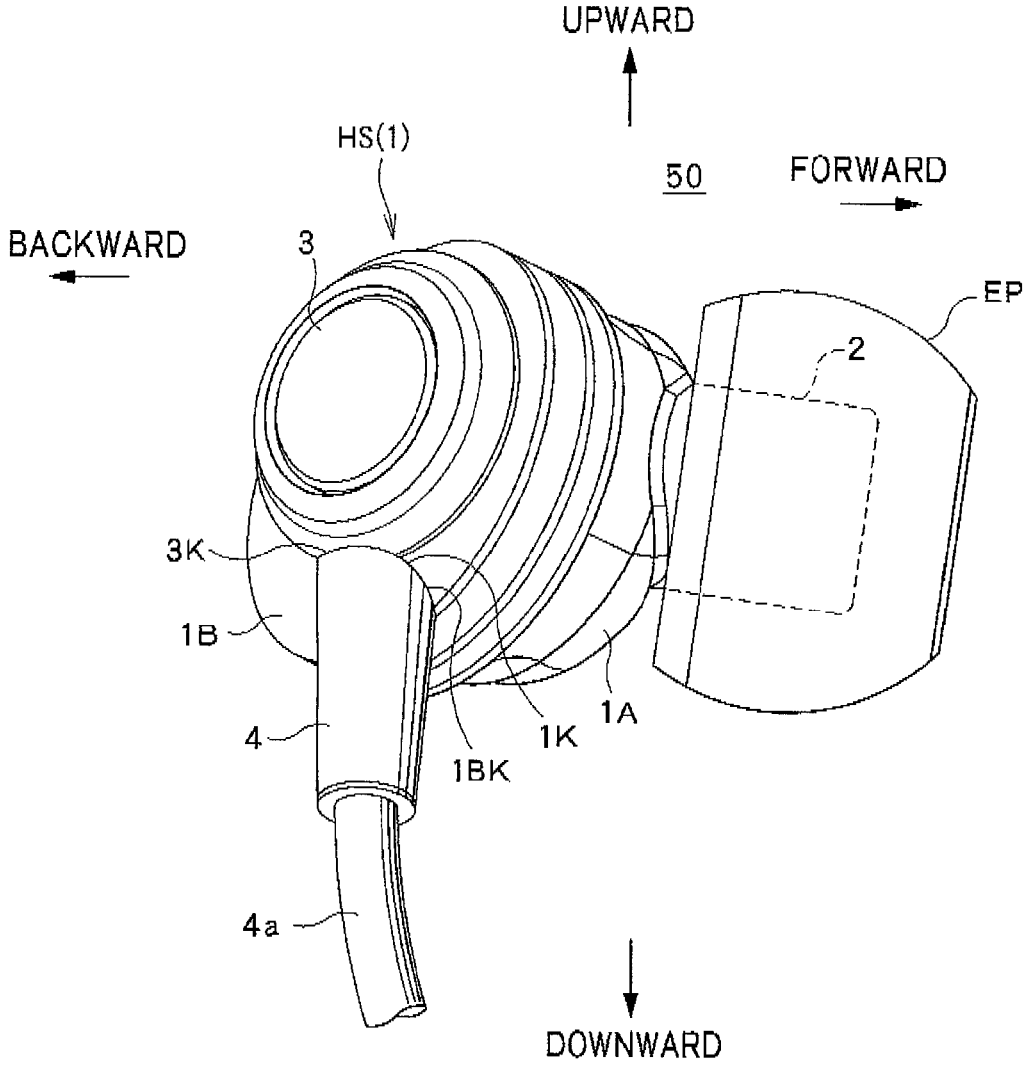
FIG. 1 an external perspective view of an embodiment of an earphone according to the present invention.

FIG. 1 is an external perspective view of an earphone 50, an embodiment of the present invention. FIG. 1 is a perspective view of the earphone 50 attached to a user's right ear (not shown) and viewed from a forward (the user's face side) and diagonally downward position.

Figure 2:
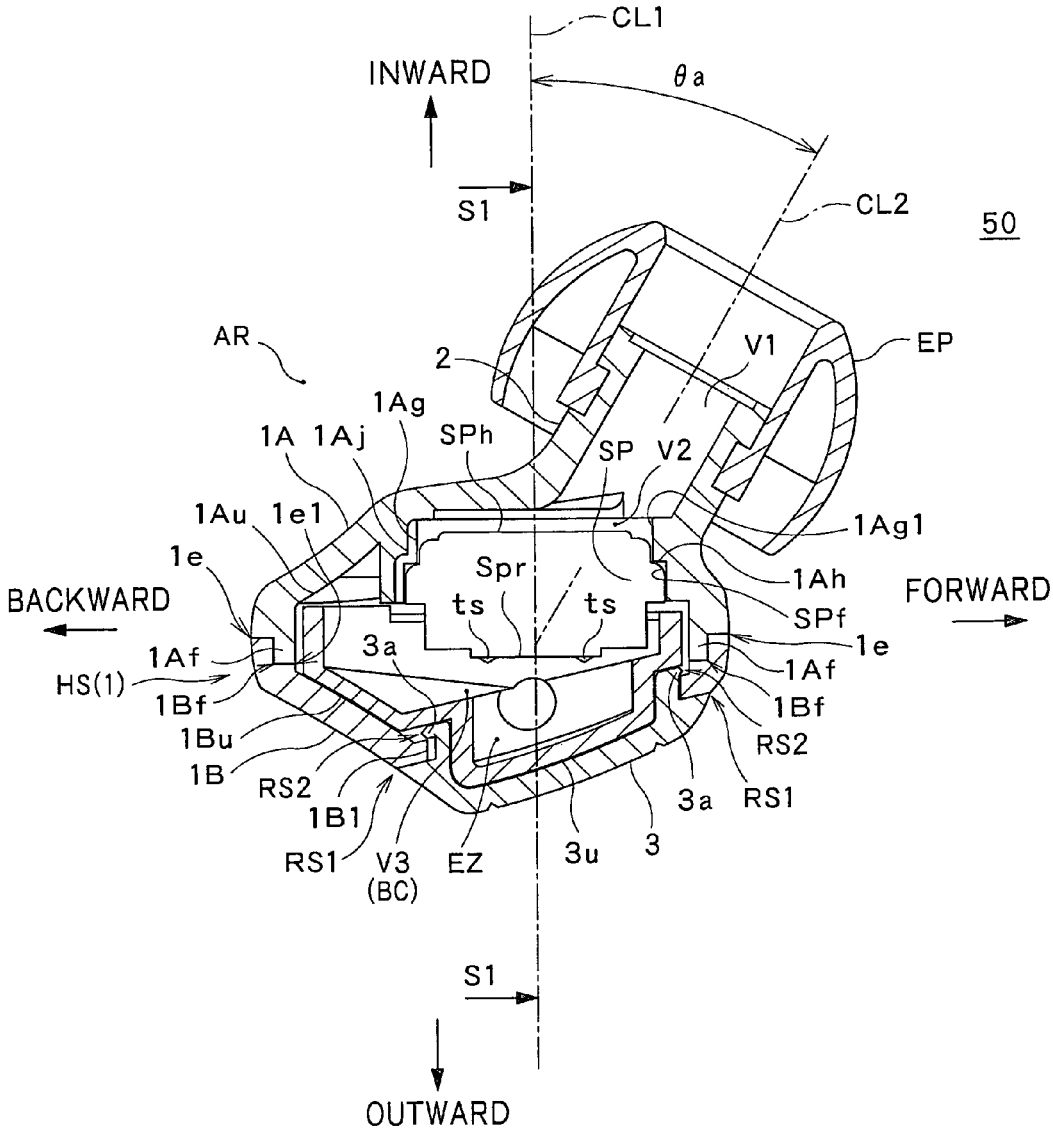
FIG. 2 is a sectional view of the embodiment of the earphone according to the present invention viewed from an upward position.
Figure 3:
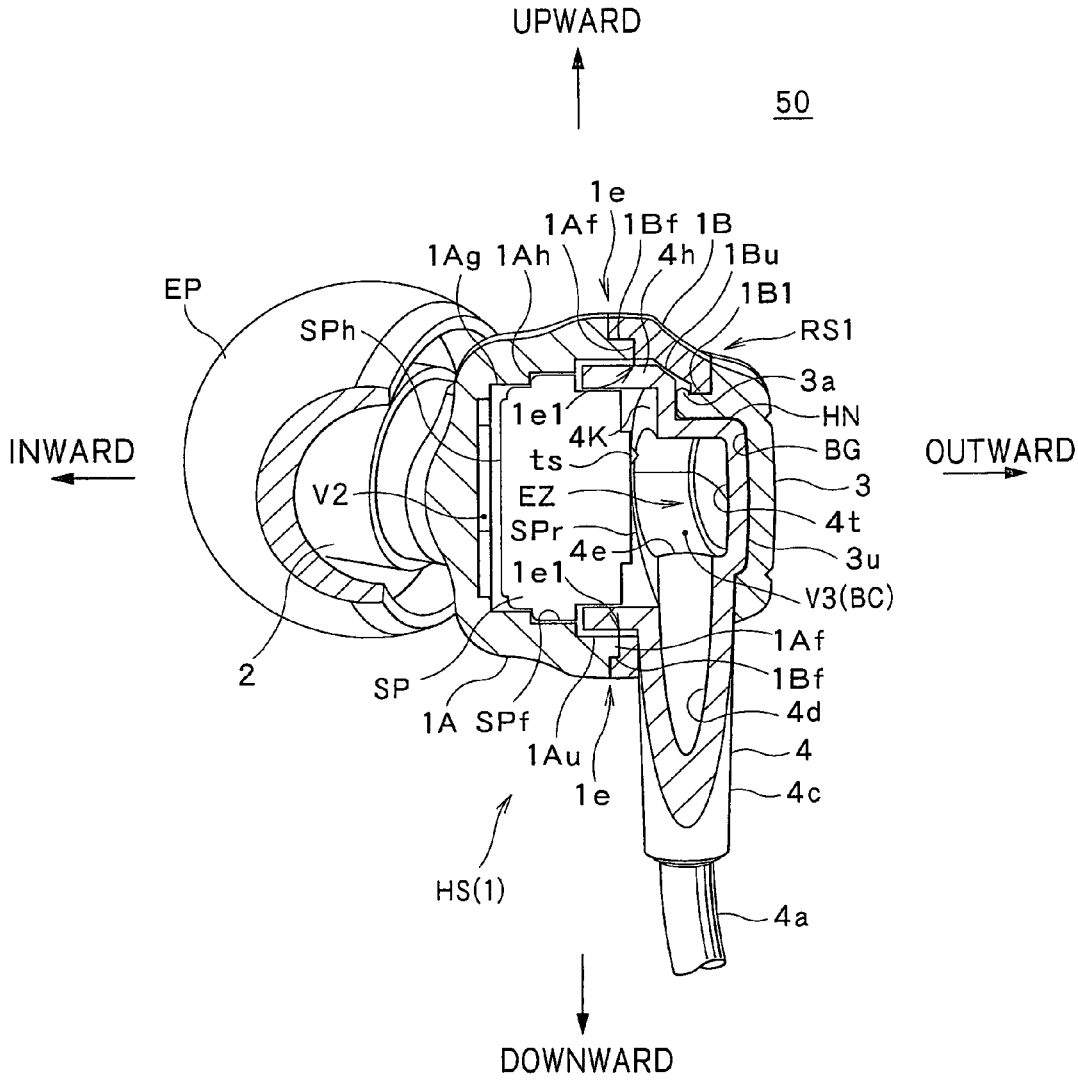
FIG. 3 is a sectional view of the embodiment of the earphone according to the present invention viewed from a forward position.

FIG. 2 is a sectional view of the earphone 50 attached to the right ear and viewed from an upward position. FIG. 3 is a sectional view of the earphone 50 attached to the right ear and viewed from a forward position, taken on line S1-S1 in FIG. 2.

The signs "FORWARD", "BACKWARD", "INWARD", "OUTWARD", "UPWARD", and "DOWNWARD" shown in the drawings indicate the directions with respect to the earphone 50 attached to the right ear.

An earphone of the present invention to be attached to a user's left ear has the shape of plane symmetry to the earphone 50 for the right ear. Thus, the earphone 50 for the right ear will only be explained in the following description.

As shown in FIGS. 1 to 3, the earphone 50 is equipped with a main body 1, a tube portion 2 that protrudes from the main body 1 in a diagonally forward and inward direction, a bushing 4 that protrudes from the main body 1 in a downward direction, and a cord 4*a* running through the bushing 4. An earpiece EP is detachably attached to tube portion 2. Part of the earpiece EP is cut away in FIG. 3 for clarity.

The earphone 50 is attached to the right ear, with at least the top of the tube portion 2 and the earpiece attached thereto being inserted into the ear channel and the main body 2 being fit inside the auricle.

The cord 4*a* connected to the speaker unit SP is running to the outside through the bushing 4. The portion of the cord 4*a* running from the speaker unit SP to the bushing 4 is omitted in FIGS. 2 and 3 for clarity.

The main body 1 consists of a front housing 1A and a rear housing 1B each formed by resin molding. The front and rear housings 1A and 1B are combined in the inward and outward directions to constitute the main body 1. A housing HS is configured to include the main body 1 (the front and rear housings 1A and 1B) and other parts, such as, an ornament 3 which will be described later.

As shown in FIGS. 2 and 3, the front and rear housings 1A and 1B are formed to have a stepped faying surface le. The housings 1A and 1B are joined to each other at the stepped faying surface le by ultrasonic welding.

The front housing 1A is provided with a rib 1Af that protrudes towards the rear housing 1B. The rear housing 1B is provided with a stepped portion 1Bf to receive the rib 1Af. The housings 1A and 1B are combined to each other so that the rib 1Af and the stepped portion 1Bf are engaged with each other to form the stepped faying surface 1e.

When the front and rear housings 1A and 1B are joined to each other by ultrasonic welding, a plurality of portions of the housings 1A and 1B, the portions of each housing being separated from each other on the faying surface 1e, are melted by ultrasonic waves. Thus, the housings 1A and 1B are joined to each other with slight gaps between the separated portions. The tube portion 2 is formed as one part of and integral with the front housing 1A.

As shown in FIG. 2, the tube portion 2 is formed so that a center axis line CL2 of the tube portion 2 has an angle ϕa with respect to a center axis line CL1 of the speaker unit SP, in relation to the angle of the ear channel. The angle ϕa is, for example, 30 degrees.

The rear housing 1B is provided with an opening 1B1 on the surface thereof in the outward direction.

A pan-like ornament 3 formed by resin molding is attached to the rear housing 1B. In detail, a paw 3*a* provided at the edge of the ornament 3 is engaged, as so-called a snap fit, with the edge of the opening 1B1 of the rear housing 1B.

With the snap fit, the ornament 3 is attached to the rear housing 1B with no filler applied to a contact surface RS1 between the ornament 3 and the rear housing 1B so that there is a slight gap at the contact surface RS1.

The housing HS is configured to include the ornament 3, the front housing 1A, and the rear housing 1B.

As shown in FIG. 2, the front housing 1A is provided with a concave portion 1Ag that communicates with a hollow space V1 of the tube portion 2. Formed on the inner surface of the concave portion 1Ag is a stepped portion 1Ah having a smaller diameter at the tube portion 2 side.

The speaker unit SP is inserted into the stepped portion 1Ah to face the tube portion 2 so that a flange SPf of the speaker unit SP is in contact with the stepped portion 1Ah. Then, the speaker unit SP is fixed in the stepped portion 1Ah with an adhesive or the like.

Provided in the front housing 1A is a space V2 at a sound emitting surface SPh side of the speaker unit SP. In detail, the space V2 is surrounded by the sound emitting surface SPh and an inner wall 1Ag1 of the concave portion 1Ag so that it communicates with the space V1.

The speaker unit SP is covered with the housing HS at a rear surface SPr side thereof so as to have a space V3. The space V3 is surrounded by the rear surface SPr, an inner surface 1Au of the front housing 1A, an inner surface 1Bu of the rear housing 1B, and an inner surface 3u of the ornament 3. The space V3 is so-called a back cavity BC.

As shown in FIG. 2, the concave portion 1Ag is provided with a groove portion 1Aj at a part thereof in a circumferential direction, having a groove cut in a direction away from the center line CL1 and lying in the inward and outward directions. The groove portion 1Aj forms a gap between the surface of the concave portion 1Ag and the flange SPf of the speaker SP. The gap lies in the inward and outward directions through which the spaces V2 and V3 communicate with each other.

This structure allows part of sounds emitted from the speaker unit SP at the space V2 side to reach the space V3 having a volume larger than the space V2, achieving stable sound quality of excellent characteristics.

Therefore, the earphone 50 does not require such a conventional sound-quality adjustment hole through which the space V2 provided in the front housing 1A communicates with an external space AR. There is thus no sound leakage through such conventional sound-quality adjustment hole, in the earphone 50.

As shown in FIG. 1, the ornament 3 has an arc-like cut-away section 3*k* at a lower part thereof in the downward direction. The rear housing 1B also has a cut-away section 1Bk at a lower part thereof in the downward direction. The cut-away sections 3*k* and 1Bk are connected to each other to provide an opening 1*k* for the bushing 4 to be fit in.

The bushing 4 will be described in detail with reference to FIGS. 4 and 5.

Figure 4:
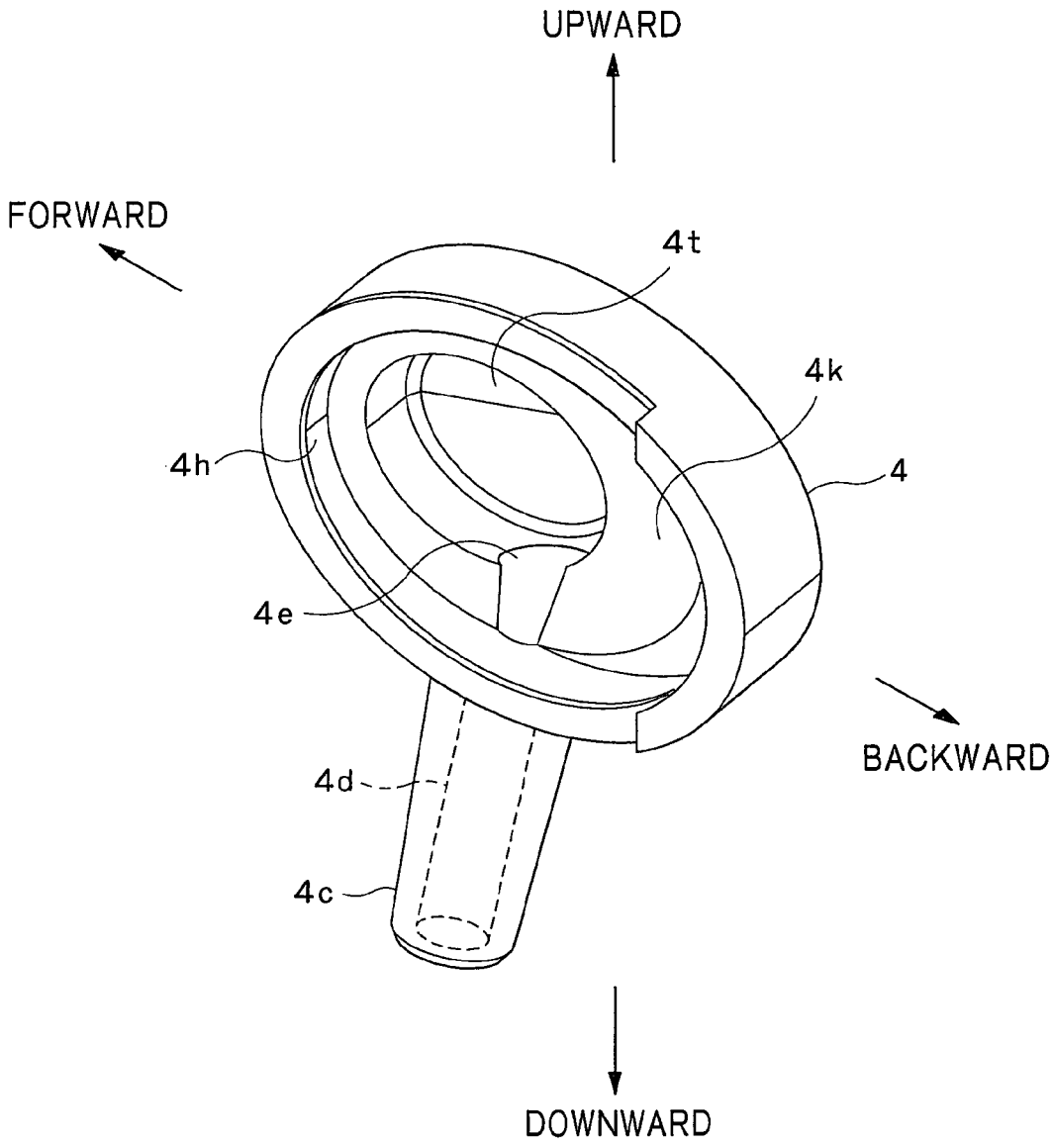
FIG. 4 is a perspective view of a bushing used in the embodiment of the earphone according to the present invention.

FIG. 4 is a perspective view of the bushing 4 viewed from diagonally upward inside the user's head when the earphone 50 is attached to the right ear.

Figure 5:
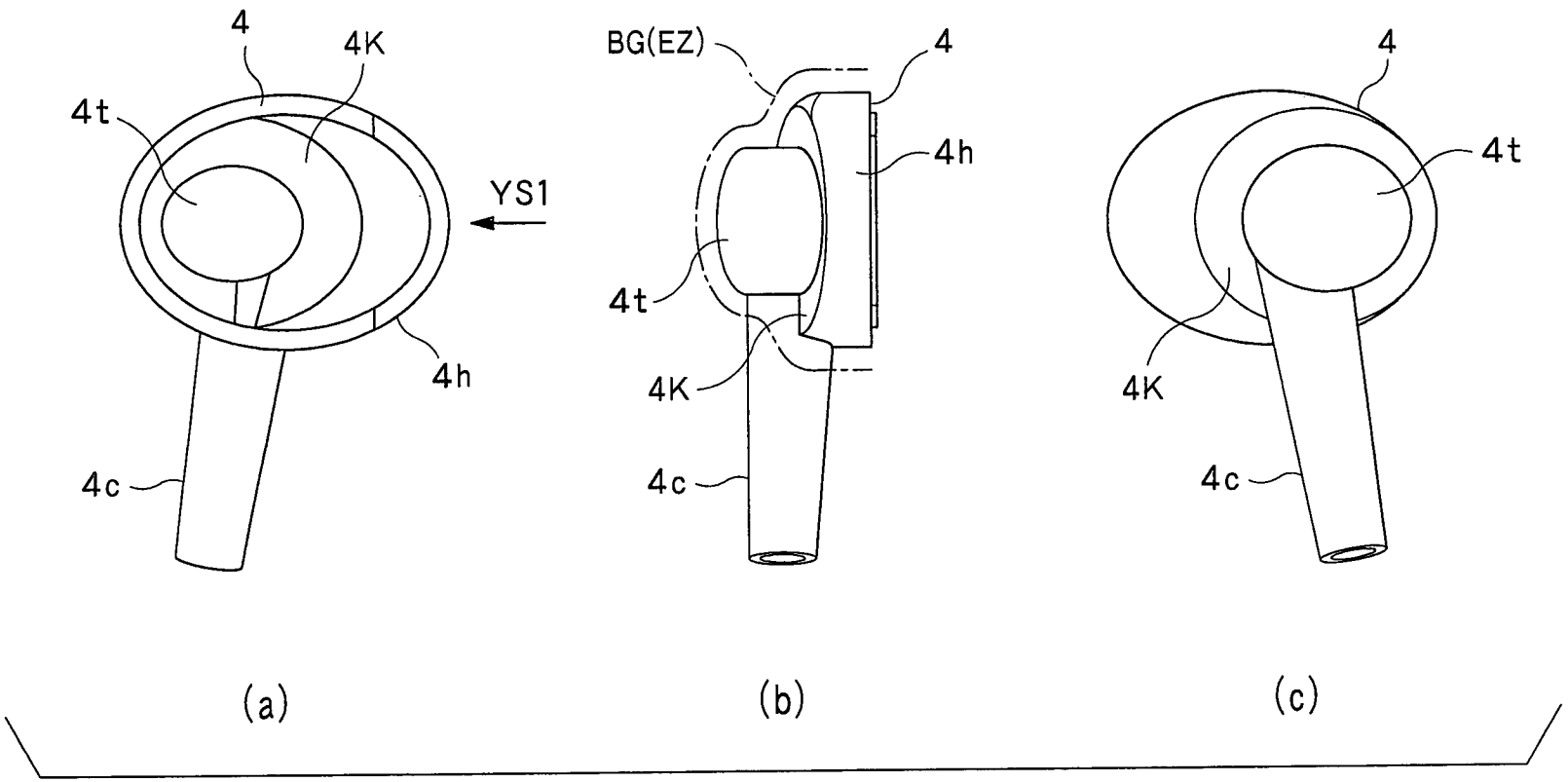
FIG. 5 is a plan view of the bushing used in the embodiment of the earphone according to the present invention viewed from three directions.

In FIG. 5, (a) is a plan view of the bushing 4 viewed from above inside the user's head when the earphone 50 is attached to the right ear, (b) being a plan view of the bushing 4 viewed in a direction indicated by an arrow YS1 in (a), and (c) being a plan view of the bushing 4, that is the reversal of the plan view of (a) in the direction vertical to the plan view of (a).

The bushing 4 is made of a material softer and more flexible than the front housing 1A, the rear housing 1B, and the ornament 3. Preferable materials for the bushing 4 are rubber, such as silicon rubber, and a form material.

As shown in FIG. 5 and also FIG. 3, the bushing 4 is constituted by a flat base portion 4*k* having a roughly oval shape, a wall portion 4*h* standing in one direction from a circumferential edge of the base portion 4*k*, an oval protruding portion 4*t* protruding in the other direction from the center area of the base portion 4*k*, a cord holding portion 4*c* having a bottom section that stretches over the base portion 4*k* and the protruding portion 4*t* and a top section that protrudes downwardly.

As shown in FIG. 4, the cord holding portion 4*c* has a hollow body with a through hole 4*d* indicated by a broken line. At the bottom section of the cord holding portion 4*c*, the through hole 4*d* is exposed through an opening 4*e* so as to stretch over the base portion 4*k* and the protruding portion 4*t*.

As shown in FIGS. 2 and 3, the speaker unit SP is provided with a pair of terminals ts to which the cord 4*a* is connected for external audio signal input at the rear surface SPr. In detail, the cord 4*a* is connected to the terminals and running therefrom to the outside through the cord holding portion 4*c* (through the opening 4*e* and the through hole 4*c*.)

The portion of the cord 4*a* extending from the terminals ts to the opening 4*c* of the bushing 4 is omitted in FIGS. 2 and 3 for clarity.

Described below in detail with respect to FIGS. 2 and 3 is the structural relationship among the front housing 1A, the rear housing 1B, and the bushing 4.

The bushing 4 is attached to the main body 1 in such a way that it is fit in the opening 1*k* (FIG. 1) so that the cord holding portion 4*c* of the bushing 4 protrudes downwardly from the opening 1*k*.

Moreover, the bushing 4 is attached to the main body 1 in such a way that an outer surface BG of the bushing 4 (referred to as a bushing outer surface BG, hereinafter) covers an inner surface HN of the housing HS (referred to as a housing inner surface HN, hereinafter.) The reference signs BG and HN are not shown in FIGS. 2 and 3 so that the drawings do not become complicated. The bushing outer surface BG stretches from the protruding portion 4*t* to the wall portion 4*h* through the base portion 4*k*, as indicated by a dash-dotted line in (b) of FIG. 5. The housing inner surface HN stretches from the ornament 3 to the front housing 1A through the rear housing 1B.

The bushing outer surface BG and the housing inner surface HN may be in contact with each other or are separated from each other with a slight gap. Or, the outer and inner surfaces BG and HN may be in contact with each other for only part of the surfaces. Moreover, the outer and inner surfaces BG and HN may be fixed to each other with an adhesive for the entire surfaces or part of the surfaces.

As shown in FIG. 3, the top of the wall portion 4*h* of the bushing 4 is inserted into a gap between the front housing 1A and the speaker unit SR When the top of the wall portion 4*h* is inserted into the gap, the contact surface RS1 between the ornament 3 and the rear housing 1B is covered by the bushing outer surface BG. More specifically, a border line RS2 (FIG. 2) between the ornament 3 and the rear housing 1B and on the contact surface RS1, that is exposed to the back cavity BC, is covered by the bushing outer surface BG.

Moreover, when the top of the wall portion 4*h* is inserted into the gap, the stepped faying surface le between the front and rear housings 1A and 1B is covered by the bushing outer surface BG. More specifically, a border line 1e1 between the front and rear housings 1A and 1B and on the stepped faying surface 1e, that is exposed to the back cavity BC, is covered by the bushing outer surface BG.

As described above, the bushing 4 is installed in the earphone 50 so that the bushing outer surface BG covers the housing inner surface HN.

The bushing 4 having the configuration described above provides a dual housing structure in which an inner housing is housed in an outer housing.

The dual housing structure, a unique feature of the present invention, has several advantages as explained below.

There are three walls created between the back cavity BC and the external space AR (FIG. 2). Those are the walls of: the back cavity BC and the external space AR (FIG. 2); the front housing 1A and the bushing 4; the rear housing 1B and the bushing 4; and the ornament 3 and the bushing 4. The three walls diminish the sounds to be leaked to the external space AR from the back cavity BC.

The bushing 4 covers the stepped faying surface 1*e* between the front and rear housings 1A and 1B, and also covers the contact surface RS1 between the ornament 3 and the rear housing 1B. This structure diminishes the sounds to be leaked to the external space AR from the back cavity BC through the stepped faying surface le or the contact surface RS1.

Moreover, the dual housing structure diminishes the sounds to be leaked to the external space AR, without respect to how the front and rear housings are combined to each other, for example, by ultrasonic welding or an adhesive.

In this embodiment, the bushing 4 covers at least part of the housing inner surface HN of the housing HS that is constituted by the front and rear housings 1A and 1B. The bushing 4 is made of a flexible material, such as silicon rubber, softer than a material of the housing HS, for example, resin. Thus, when sounds are emitted to the back cavity BC, a portion of the sounds is reflected on the bushing outer surface BG of the bushing 4. If the bushing 4 is not provided, the sounds emitted to the back cavity BC are reflected on the inner surface HN of the housing HS. The energy of the sounds is more attenuated by the bushing 4 than by the housing HS.

The dual housing structure, a unique feature of the present invention, will be described more in detail.

The bushing 4 that supports the cord 4*a* running from the main body 1 has an extended portion EZ (FIG. 3) that is installed in the back cavity BC of the main body 1 from an end section of the cord supporting portion 4*c*. The extended portion EZ is formed into a unique shape that is spread along the inner surface of at least the rear housing 1B. The extended portion EZ acts as an inner housing to cover the inner surface of at least the rear housing 1B. And, the rear housing 1B whose inner surface is covered by the extended portion Ez acts an outer housing.

The extended portion EZ of the bushing 4 has a unique shape, like a dish antenna, as shown in FIG. 5, placed on the cord holding portion 4*c*, spread around 360 degrees, with an end section of the cord holding portion 4*c* being roughly the center of the dish-like shape.

The extended portion EZ of the bushing 4 covers at least part of the outer housing. However, it is more preferable that the extended portion EZ also covers the rear surface SPr of the speaker unit SP in such a manner that the top of the wall portion 4*h* of the bushing 4 is inserted into the gap between the front housing 1A and the speaker unit SP, as shown in FIG. 3. Moreover, the extended portion EZ covers at least the border line between two components of the outer housing when the outer housing is constituted by a plural number of components (that are the front housing 1A, the rear housing 1B, and the ornament 3 of the hosing HS in the embodiment.)

In known earphones, the number of components is increased for the dual housing structure. On the contrary, in the earphone 50 of the embodiment, the extended portion EZ that is part of the bushing 4 acts as the inner housing of the dual housing structure, thus there is no increase in the number of components for the dual housing structure.

Moreover, the bushing 4 of the earphone 50 has the portion that is installed in the main body 1, that is the extended portion EZ larger than the portion of a bushing to be installed in a main body of a known earphone. The bushing 4 is thus hardly detached from the main body 1 when the cord 4*a* is forcefully pulled from the main body 1.

It is further understood by those skilled in the art that the foregoing description is a preferred embodiment of the disclosed device and that various changes and modifications may be made in the invention without departing from the spirit and scope thereof.

For example, the hosing HS of the earphone 50 is constituted by the three components (the front housing 1A, the rear housing 1B, and the ornament 3). However, the housing HS may be constituted by four or more, or two or less of components.

Moreover, the speaker unit SP installed in the main body 1 of the earphone 50, may be attached to the top of the tube portion 2 so that the speaker unit SP is inserted into the ear channel with the earpiece EP in use. This type of earphone is disclosed, for example, in Patent Application Publication No. US 2009/0304220A1.

The spaces V1 and V2 do not exist when the present invention is applied to such type of earphone. In this case, the only space V3 (the back cavity BC) includes the hollow space of the tube portion 2. The extended portion EZ may extend from the space V3 to the hollow space of the tube portion 2.

In the embodiment, the top of the wall portion 4*h* of the bushing 4 is inserted into the gap between the front housing 1A and the speaker unit SP, as shown in FIG. 3, which further decreases the sound leakage to the outside. However, this is not an essential structure in this invention.

In the embodiment, the extended portion EZ of the bushing 4 has a unique shape, like a dish antenna, as shown in FIG. 5, placed on the cord holding portion 4*c*, spread around 360 degrees, with an end section of the cord holding portion 4*c* being roughly the center of the dish-like shape. However, the extended portion EZ may not necessarily lie continuously in 360 degrees. The extended portion EZ may have any shape spread along the housing inner surface HN of the hosing HS and having slits or the like, as long as the dual housing structure described above is achieved.

As disclosed above in detail, the present invention provides an earphone with a dual housing structure that allows smaller sound leakage.

What is claimed is:

1. An earphone comprising:

a speaker unit having a sound emitting surface through which a sound is emitted and a rear surface, on both sides of the speaker unit;

a bushing through which a cord that carries an audio signal to the speaker unit runs to the outside of the earphone; and a housing having a first housing member, a second housing member, and a third housing member that are combined with each other to constitute the housing, wherein the housing covers the speaker unit and covers a portion of the bushing, wherein a back cavity is provided between the rear surface of the speaker unit and the portion of the bushing, the back cavity being surrounded by inner surfaces of the first, second, and third housing members, such that the portion of the bushing extends into the housing so that the portion of the bushing covers a border line between the first and second housing members, and a border line between the second and third housing members.

2. The earphone according to claim 1, wherein the speaker unit is housed in one of the first, second, and third housing members with a gap between the speaker unit and the one housing member, a top of the portion of the bushing being inserted into the gap so that the portion of the bushing covers the speaker unit.

3. The earphone according to claim 1, wherein the bushing is made of a material softer than a material of the housing.

* * * * *